US005362040A

United States Patent [19]

Midavaine et al.

[11] Patent Number: 5,362,040

[45] Date of Patent: Nov. 8, 1994

[54] DEVICE FOR TRANSFERRING FLAT OBJECTS USING A CONVEYOR BELT AND DRUM ARRANGEMENT

[75] Inventors: Pierre Midavaine, Belcodene; Jean Roch, Simiane-Collongue, both of France

[73] Assignee: Bertin & CIE, Plaisir, France

[21] Appl. No.: 988,119

[22] PCT Filed: Jun. 12, 1992

[86] PCT No.: PCT/FR92/00532

§ 371 Date: Feb. 11, 1993

§ 102(e) Date: Feb. 11, 1993

[87] PCT Pub. No.: WO92/22386

PCT Pub. Date: Dec. 23, 1992

[30] Foreign Application Priority Data

Jun. 14, 1991 [FR] France ..... 91 07296

[51] Int. Cl.[5] ..... B65H 5/00

[52] U.S. Cl. ..... 271/225; 271/275; 271/177; 271/184; 271/292; 198/457; 198/531; 198/532; 198/605

[58] Field of Search ..... 271/2, 184, 225, 178, 271/181, 272, 275, 306, 177, 292; 198/443, 457, 531, 532, 605, 612, 629

[56] References Cited

U.S. PATENT DOCUMENTS

| | | | |
|---|---|---|---|
| 2,761,680 | 9/1956 | Lens . | |
| 2,925,271 | 2/1960 | Faeber | 271/178 |
| 2,937,739 | 5/1960 | Levy . | |
| 3,519,145 | 7/1970 | MacDonald . | |
| 4,974,826 | 12/1990 | Svyatsky et al. | 271/181 X |
| 5,080,666 | 1/1992 | Kulpa et al. | 271/2 X |

FOREIGN PATENT DOCUMENTS

| | | | |
|---|---|---|---|
| 480822 | 4/1992 | European Pat. Off. . | |
| 1471484 | 3/1967 | France . | |
| 2431450 | 2/1980 | France . | |
| 2593416 | 7/1987 | France . | |
| 1284131 | 11/1968 | Germany | 271/181 |
| 138073 | 5/1990 | Japan | 271/181 |
| 796141 | 1/1981 | U.S.S.R. | 271/184 |

OTHER PUBLICATIONS

Creedon et al., Card Feed System, Jun. 1971, IBM Tech. Disclosure Bulletin, vol. 14, No. 1, p. 136.

*Primary Examiner*—Robert P. Olszewski
*Assistant Examiner*—Boris Milef
*Attorney, Agent, or Firm*—Watson, Cole, Grindle & Watson

[57] ABSTRACT

The disclosed device allows individual transfer of flat objects from an input conveyor on which the objects move in a same plane according to a given direction into receptacles moving at right angles with respect to the direction. It is comprised of a sequentially driven reception conveyor intended to receive one by one the objects resting in a position slightly inclined with respect to the vertical, and a transfer member moving in synchronism with the conveyor in order to transfer to an injection position towards a receptacle the lower edge of an object resting on the reception conveyor. The device may be used in a postal sorting machine.

10 Claims, 3 Drawing Sheets

DEVICE FOR TRANSFERRING FLAT OBJECTS USING A CONVEYOR BELT AND DRUM ARRANGEMENT

The present invention relates to a device for individually transferring flat objects, in particular for a postal sorting machine.

Postal sorting machines comprise tools for acquiring and processing images of mail in order to carry out the automated encoding of the addresses by automatic recognition or by video encoding using a recognition carried out by an operator in deferred time. The cost of these installations leads to seeking high productivity for these operations. However, the handling mechanics of existing equipment does not always allow rates to be obtained which are compatible with the performance conferred by the acquisition optoelectronics and the processing electronics.

Postal sorting machines are known of the type comprising a module for unstacking the objects to be sorted, a conveyor or antenna in which the postcode is read and in which a direction is assigned to flat objects moving one after another in the same plane, and a transfer device or injector which receives the objects at the outlet of the conveyor and injects them one by one into bins of a carousel for the purpose of routing them into a compartment corresponding to the destination which has been assigned to the object when it passed through the antenna.

In this way, the document U.S. Pat. No. 2,761,680 describes a transfer device comprising a sequentially driven transfer member adapted so as to transfer the lower edge of flat objects received one by one from an input conveyor from a reception position to a position for ejection towards a receptacle. The transfer member comprises two channels arranged symmetrically with respect to an axis of rotation and which are placed in the extension of the input conveyor in order to receive, one by one, the letters which are held in a position which is slightly inclined with respect to the vertical, by a fixed wall. Once a letter is in position on one of the channels, the transfer member carries out a rotation through 180° about the axis and the other channel is placed in the extension of the input conveyor in order to receive the following letter.

Now, in postal sorting machines of the aforementioned type, the rate of the unstacking module may reach high values of the order of three objects per second, for example, and the output of the conveyor or antenna may easily be adapted to reach such a rate. In contrast, the rate of known transfer devices, which combine a horizontal movement for input of the object to the injector and a vertical movement for insertion into the receptacles of the carousel, may be difficult to increase because, for higher transfer speeds, the mail risks flying away and, for higher outputs, there is a high risk of damaging the objects. Such is the case of the transfer device according to U.S. Pat. No. 2,761,680.

The invention aims to provide a transfer device which allows, without damage, flat objects to be transferred individually at a high rate and in a reliable manner from a conveyor, on which the said objects move in the same plane in a given direction, into receptacles moving at right angles to the said direction, and this being in synchronism with the movement of the said receptacles and without disturbing the operation of the conveyor and, possibly, of the upstream unstacking module, from which the flat objects are brought to the transfer device.

For this purpose, the subject of the invention is such a device comprising a transfer member adapted so as to transfer the lower edge of the flat objects received one by one from the input conveyor from a reception position to a position for ejection towards a receptacle, characterized in that the said transfer member is shaped so as jointly to allow the arrival of at least one flat object in the said reception position and the transfer of another flat object into a receptacle from the said ejection position, and in that the said device also comprises a reception conveyor adapted in order to hold the said flat objects resting on the said transfer member in a position which is slightly inclined with respect to the vertical and to move them from the reception position to the ejection position in conjunction with said transfer member.

By virtue of this arrangement, the phase for inserting the objects into the transfer zone above the bins and the injection phase or phase for vertical transfer into the receptacles, which cannot be reduced, may overlap in order to reach the desired performance.

Preferably, the said transfer member consists of a rotary drum provided, at its periphery, with longitudinal grooves for receiving the lower edge of the said objects.

According to a preferred embodiment of the invention, the said reception conveyor carries a set of stops which can move at right angles to the said input conveyor in order to receive the said flat objects one by one therefrom and to move them into the ejection position in conjunction with the said transfer member.

According to a second embodiment of the invention, the said reception conveyor is an endless belt conveyor arranged substantially in the same plane and moved in the same direction as the input conveyor, the said belt carrying cams able to interact with the front edge of an object in order to immobilize it during the transfer in progress of an object by the said transfer member.

Other characteristics and advantages of the invention will emerge from the description which will follow, given with reference to the appended drawings given solely by way of examples and in which.

Figure 1:
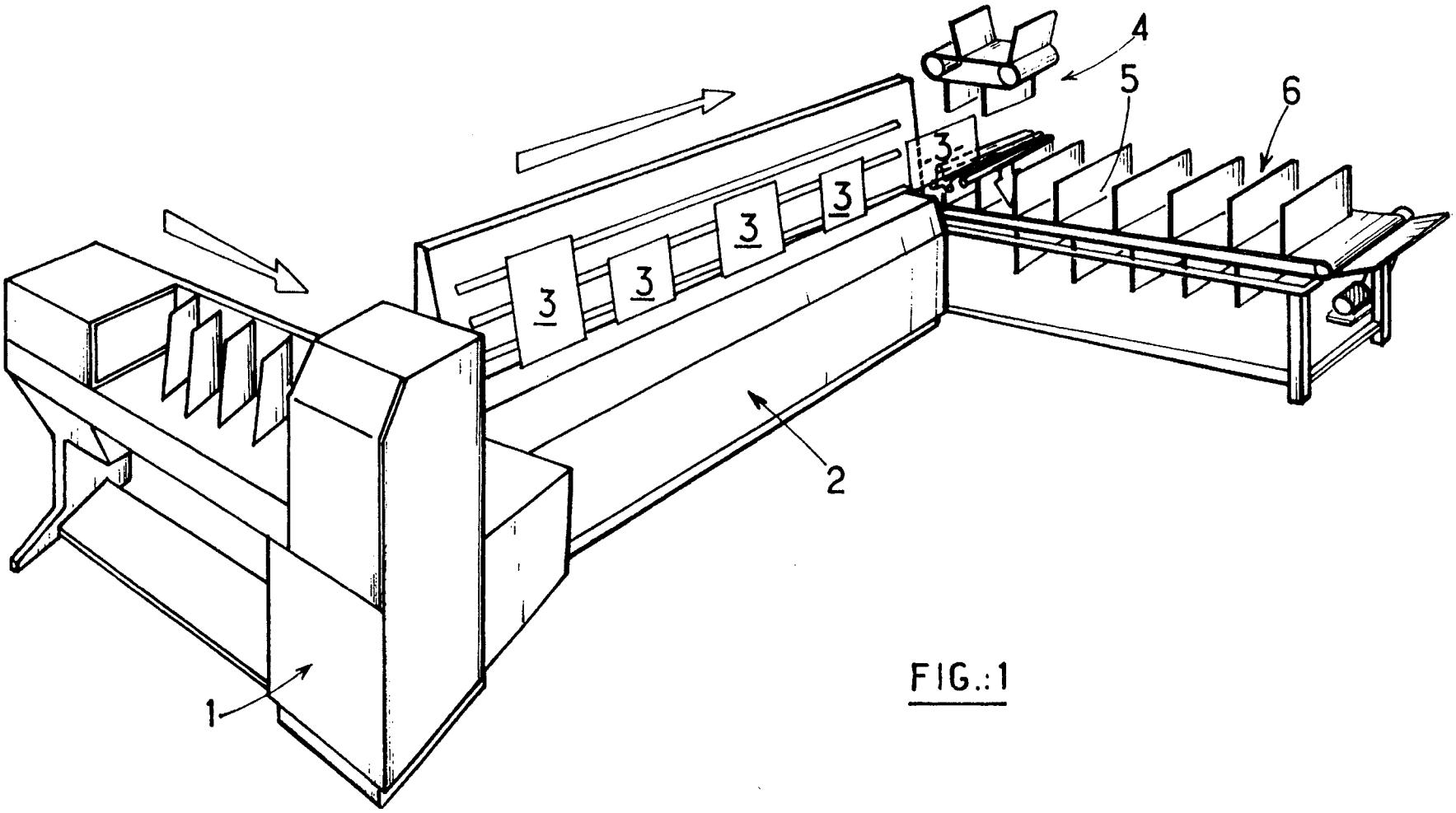
FIG. 1 is a diagrammatic perspective view of a postal sorting machine comprising a transfer device according to the invention.
Figure 2:
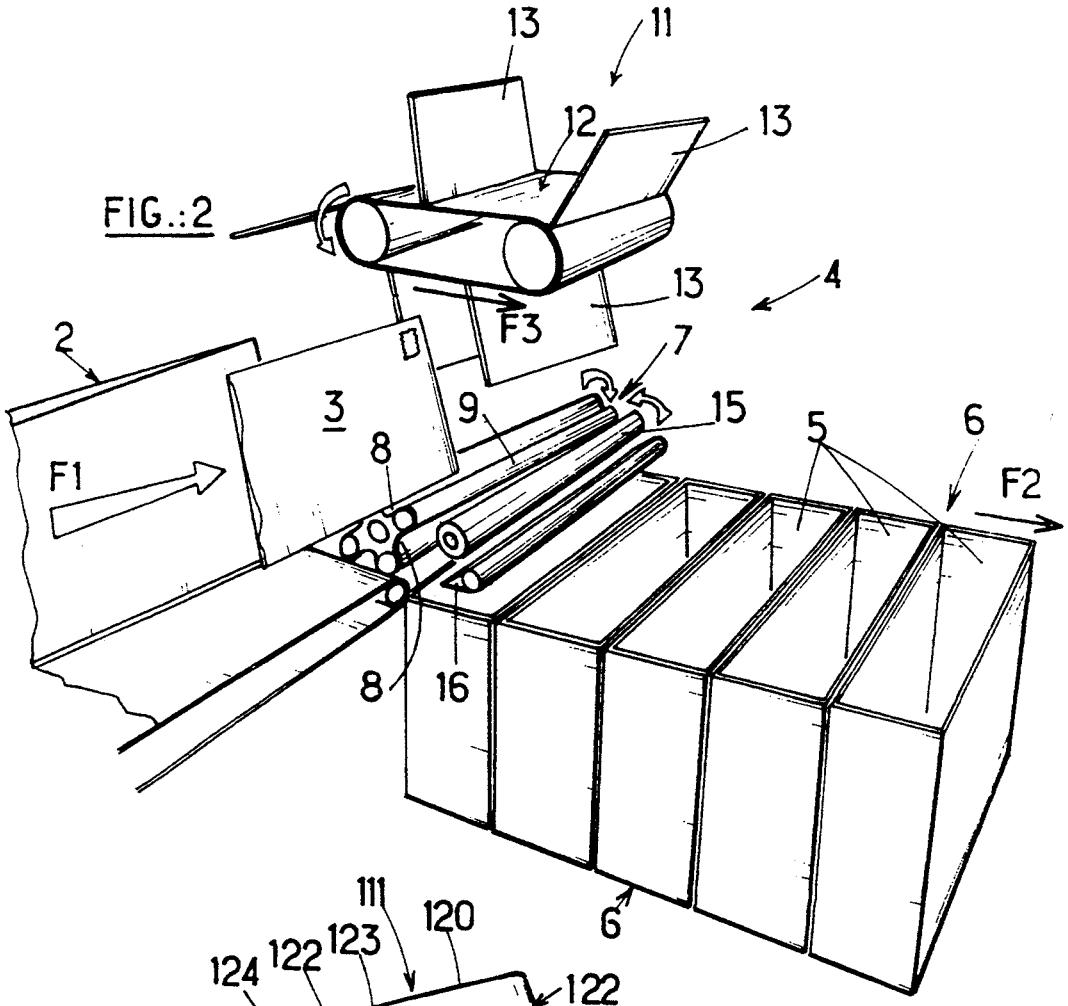
FIG. 2 is a blown-up perspective view of the transfer device according to a preferred embodiment of the invention.

With reference to FIG. 1, a postal sorting machine comprises an unstacking module 1 in which flat objects arranged in a stack are taken up one by one by conventional means and brought to the inlet of an output conveyor or antenna 2 in which the flat objects move one after another in the same plane past conventional automatic recognition and encoding means which have not been shown for the clarity of the drawing. Postal sorting machines comprising such unstacking and recognition and encoding modules are well known to the specialists in the art and there is no need to give a detailed description thereof here. At the outlet of the conveyor 2, the objects 3 arrive one by one in a transfer device or injector 4 which transfers each object 3 into a bin 5 of a carousel 6 consisting of a set of juxtaposed bins which move under the transfer device 4 in a direction at right angles to that in which the objects 3 are conveyed in the conveyor 2.

According to a preferred embodiment of the invention, illustrated in FIGS. 2 to 5, the transfer device 4 comprises a rotary drum 7 provided, at its periphery, with four longitudinal grooves 8 distributed at 90° from one another with respect to the axis of the drum, the ridges separating two adjacent grooves consisting of rollers 9 mounted in a scallop of the tooth 10 (FIG. 3) separating two adjacent grooves.

The axis of rotation of the roller 7 is directed parallel to the routing direction F1 of the conveyor 2 in such a manner that the flat objects 3 leaving the conveyor each come to rest, resting via their lower edge in one groove 8 of the drum 7.

The drum or turnstile 7 is mounted above the carousel 6 whose bins or receptacles 5 move in a direction illustrated by the arrow F2 at right angles to the direction F1 of movement of the objects 3 on the conveyor 2.

Above the drum or turnstile 7 there is mounted an assembly 11 consisting of an endless belt conveyor 12 whose lower strand is directed parallel to the direction of movement of the bins 5. The lower strand of the belt 12 is moved in the direction of the arrow F3, which is the same as the direction F2 of movement of the bins. The belt of the conveyor 12 externally carries a certain number of paddles 13 arranged obliquely with respect to the upper and lower strands of the belt. When a paddle 13 driven by the belt of the conveyor 12 is presented substantially in the extension of the conveyor 2, it forms a resting surface or base for the back side of the flat object or letter being removed from the conveyor 2, whilst the lower edge of this object is received in that of the grooves 8 of the drum 7 which is adjacent to the paddle and turned upwards. In this position, the lower edge of the paddle 13, which is parallel to the rollers 9, is situated substantially vertically in line with, and at a slight distance from the roller 9 delimiting the back edge (in the direction of the arrow F3) of the groove for receiving the object, and the paddle 13 has an inclination with respect to the vertical close to that of the objects 3 at the outlet of the conveyor 2. Preferably, the paddles 13 and the letters 3 are then inclined towards the rear (in the direction of the arrow F3) by approximately 15° to 20° with respect to the vertical. The distribution of the paddles 13 along the belt of the conveyor 12 is chosen in such a manner that the distance between two consecutive paddles in the direction F3 is substantially equal to the distance which separates two consecutive rollers 9 of the drum 7.

The rotational movements of the drum 7 and the movement with which the conveyor 12 drives the paddles 13 are synchronized with one another (and possibly with the carousel 6), as well as with the modules 1 and 2 in such a manner that a flat object 3 leaving the conveyor 2 is always presented so as to be received by a paddle 13 and a groove 8 of the drum 7.

A substantially vertical fixed partition 14 having approximately the same height as the paddles 13 may be arranged on the opposite side of the conveyor 2 in order longitudinally to retain the letters 3 when they are removed at high speed from the conveyor 2 and in order thus to prevent them from being ejected beyond the drum 7.

The transfer device 4 is supplemented by a vertical motorization roller 15 arranged parallel to the drum 7, downstream of the latter with respect to the direction F2 of movement of the bins 5 and of the paddles 13, at the height of the drum 7. Preferably, the roller 15 is mounted on a flexible articulation (not shown) in order to be forced elastically in the direction of the drum 7 and thus to adapt to the thickness of the flat object 3 which, during injection into a bin 5, is pinched between a free roller 9 of the drum 7 and the motorized roller 15.

Finally, the transfer device 4 may be supplemented by a retractable retaining blade 16 arranged substantially under the pinching gap between the drum 7 and the roller 15, in the injection path of the objects 3 towards the receptacles or bins 5, in order to retain an object before it is injected into a receptacle 5. The rotational movement of this blade 16 between its closed position for retaining the objects 3 and its open injection position is synchronized with the movement of the carousel 6 in order to ensure a perfectly synchronized injection of the objects 3 into the bins or receptacles 5.

Figure 3:
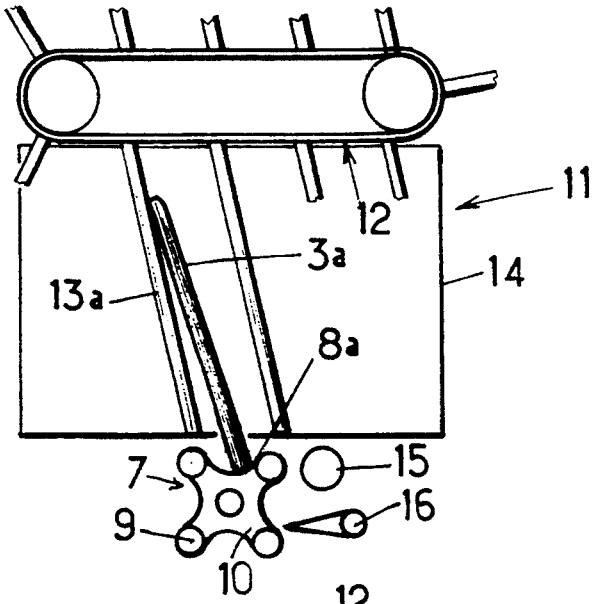
FIGS. 3, 4 and 5 are side elevation diagrammatic views illustrating the device of FIG. 2 during three different phases of its operation.

FIG. 3 shows an object 3*a* coming from the conveyor 2 arranged resting against a paddle 13*a* via its back side and a groove 8*a* of the drum 7 via its lower edge.

Figure 4:
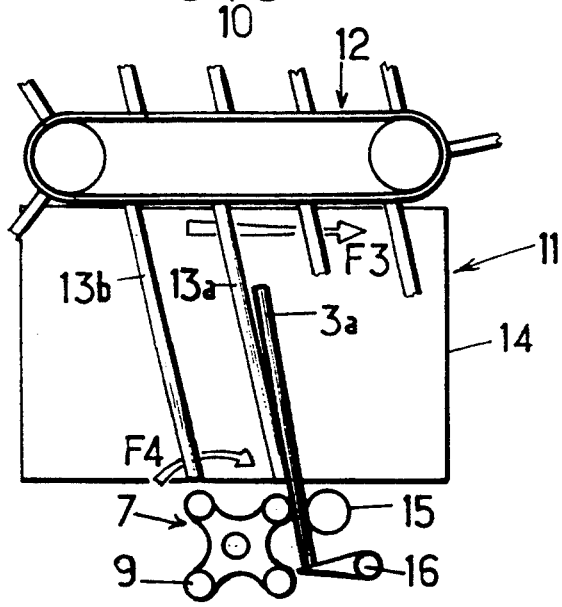

The conveyor 12 and the drum 7 are driven step by step in a synchronous manner and FIG. 4 shows the belt of the conveyor 12 and the paddles 13 having advanced by one step in the direction of the arrow F3 (parallel to the arrow F2 of FIG. 2), whilst the drum 7 has revolved through a quarter of a turn in the direction indicated by the arrow F4. In this position, the object 3*a* is pinched between one of the rollers 9 of the drum 7 and the motorized roller 15, with the blade 16 therefore preventing the injection of the object 3*a* into one of the bins of the carousel 6 situated underneath and not shown in the drawing.

Figure 5:
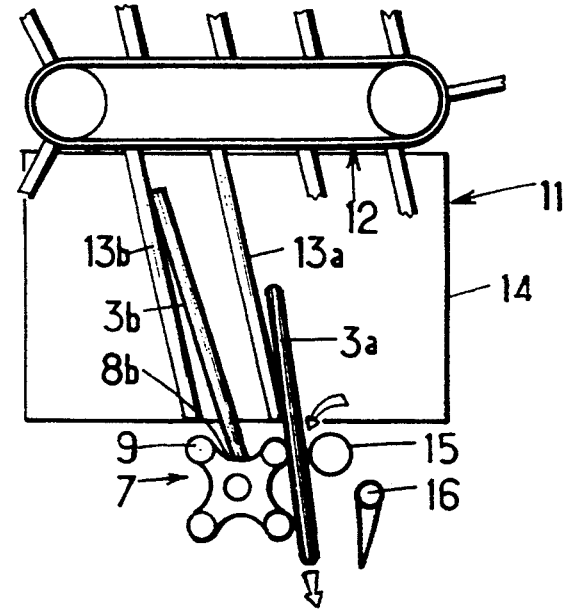

In FIG. 5, the assembly 11 with paddles 13 and the drum 7 are still in the same position, but the blade 16 has tilted downwards and the motorized roller 15 drives the object 3*a* in order to inject it into a receptacle (not shown) of the carousel 6 situated underneath. During this same phase, a new object 3*b* is received resting against the following paddle 13*b* and the following groove 8b of the drum 7 and, once the letter 3*a* has been ejected into a bin by the motorized roller 15, the process is repeated for the ejection of the letter 3*b* into the following bin by advancing the conveyor 12 by one step and rotating the drum 7 by a quarter of a turn.

Figure 6:
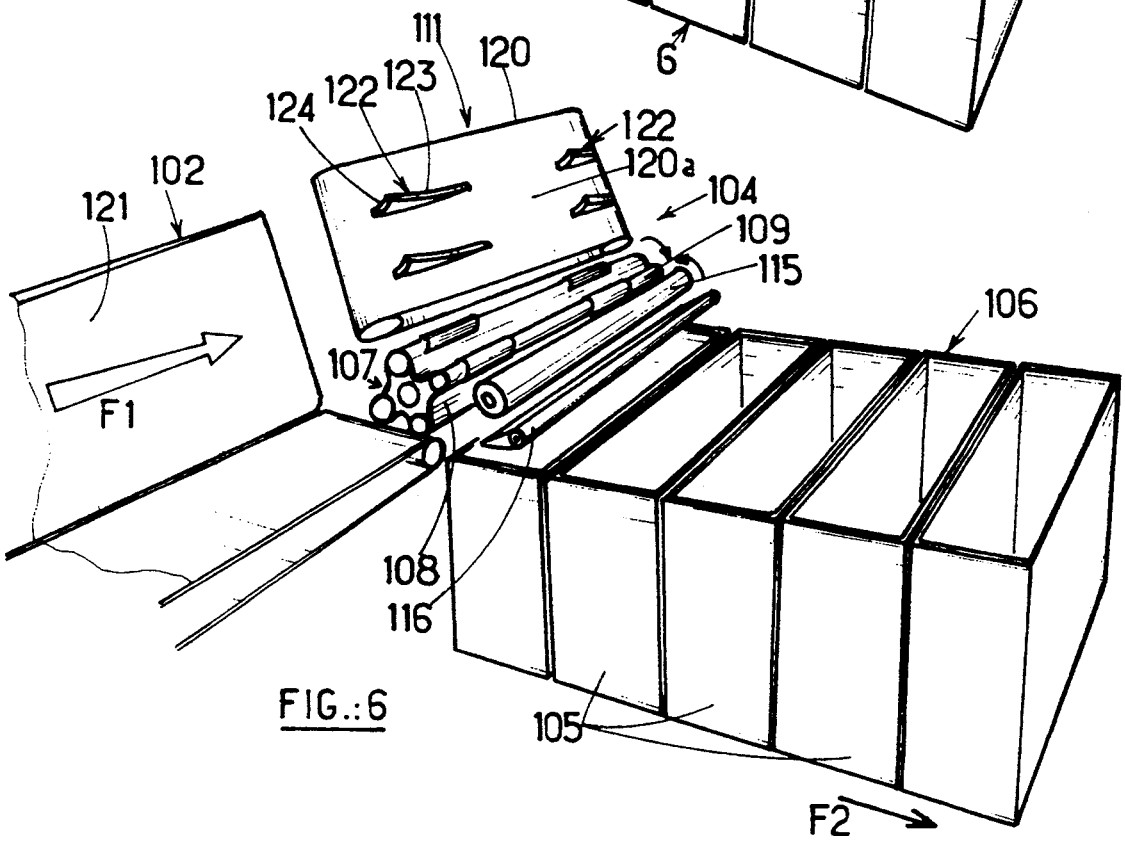
FIG. 6 is a blown-up perspective view analogous to FIG. 2, illustrating an embodiment variant of the transfer device.

In the second embodiment of FIG. 6, the assembly 11 with paddles 13 is replaced by an endless belt 120 conveyor 111. The other elements are identical to those of FIGS. 1 to 5 and the same reference numbers, increased by the FIG. 100, denote the corresponding elements.

The endless belt 120 has two plane strands one 120*a* of which is arranged in the extension of the conveyor 2, substantially in the same plane as the surface 121 for the letters to rest on the conveyor 102. The belt 120 moves in the direction of the arrow F1 and carries, at regular intervals along the longitudinal direction of the belt, two identical cams 122 spaced apart and aligned along the height of the belt 120. Each cam 122 has, in a plane perpendicular to that of the belt 120, the shape of a wedge whose tip is directed forwards considering the direction F1 of forward travel of the belt. Considered on the strand 120*a*, each cam 122 therefore defines a ramp surface 123 which, in the direction opposite that of the arrow F1, moves progressively away from the plane of the strand 120*a* with a slight inclination with respect to this plane. The rear end of the ramp surface 123 is connected to the surface of the belt 120 by a stop surface 124 which is steeply inclined or perpendicular to the plane of the strand 120*a*. This stop surface may be rectilinear or curved. The cams 122 are preferably made from an elastic material so that they can match the curvature of the belt at each end of the conveyor 111.

In operation, the conveyor 111 is driven step by step in synchronism with the modules 1 and 102, the drum 107 and the carousel 106.

When a letter arrives at the outlet of the conveyor 102, it comes to rest via its front edge against the stop surfaces 124 of the two cams 122 situated on its path. When the belt 120 advances by one step, the letter is transferred progressively from the conveyor 102 to the conveyor 120, and the letter stops its travel in a position in which the lower edge of the letter rests entirely in a groove 108 of the drum 107 and in which, depending on the length of the letter, its rear part is moved away from the strand 120*a* to a greater or lesser extent by the ramp surface 123. The drum 107 is then revolved by a quarter of a turn so that the letter is inserted in the gap between a roller 109 and a motorized roller 115 which ejects it towards a receptacle 105 of the carousel 106. The movements of the conveyor 111 and of the drum 107 are therefore synchronas but not in phase.

During this ejection process, a new letter coming from the conveyor 102 comes to rest against the stop surface 124 of the following two cams, then is transferred into the ejection position, and the process is thus reproduced sequentially.

The transfer device according to the invention consequently makes it possible to provide the sequential transfer of the objects coming from the conveyor 2, 102 into the carousel 6, 106 at a high rate and in synchronism with the said carousel, and without disturbing the operation of the installation feeding the upstream conveyor 2, 102 by virtue of the fact that the phase of inserting the object into the transfer zone above the bins and the phase for vertical injection into the bin are spatially disassociated and the fact that the transfer device may thus receive a new object in the reception position, whilst a previously received object is in the injection position or is being moved towards this position. The overlap of at least two objects in the transfer device allows high performance to be reached compatible with those of the conveyor 2 and of the carousel 6.

It goes without saying that the embodiments described are but examples, and they could be modified, especially by substituting equivalent techniques, without for all this departing from the scope of the invention. Thus, for example, the movements of the transfer member (drum) and of the receiving conveyor may be continous instead of being sequential, the transfer member may assume any suitable form other than a drum, the paddles 13 of the reception conveyor 11 may be replaced by stop elements having some other configuration.

We claim:

1. A flat object feeding machine comprising an input conveyor on which flat objects move longitudinally one by one along a substantially horizontal linear path in a plane slightly inclined with respect to vertical, receptacles for said flat objects moving at a right angle to said path, and a device for individually transferring said flat objects fed from said input conveyor into said receptacles, wherein said device comprises (a) a movable transfer member extending above said receptacles and comprising support means extending substantially in prolongation of said linear path for receiving said flat objects one by one lengthwise in a reception position wherein the lower edge of one said flat objects rests on said support means, driving means for moving said support means at a right angle to said path from said reception position to an ejection position wherein said support means releases said lower edge, and ejection means for ejecting said released one flat object downwards into one of said receptacles, said transfer member being shaped so as jointly to allow the arrival of at least one of said flat objects in said reception position and the ejection of another of said flat objects from said ejection position, and (b) a reception conveyor comprising stop means for holding substantially in said plane one of said flat objects received in said reception position on said transfer member and for moving said one object in said slightly inclined position from said reception position to said ejection position in conjunction with said transfer member.

2. Machine according to claim 1, wherein said transfer member consists of a rotary drum provided at a periphery thereof with longitudinal grooves for receiving said lower edge of said objects.

3. Machine according to claim 2, comprising means driven by said input conveyor for providing said drum and said reception conveyor with step by step movements synchronized with the ejection rate of said flat objects away from said input conveyor.

4. Machine according to claim 2, wherein said drum comprises idler rollers separating said grooves into pairs.

5. Machine according to claim 1, wherein said ejection means comprise a motorized roller mounted adjacent said transfer member so as to define therebetween a pinching gap for said flat objects.

6. Machine according to claim 5, comprising resilient means for urging said motorized roller elastically in the direction of said transfer member.

7. Machine according to claim 5, comprising a retractable blade mounted below said pinching gap and able to move in synchronism with the movement of said receptacles between an object-retaining position and a position for injecting an object into a receptacle.

8. Machine according to claim 1, where said stop means of said reception conveyor comprises a set of stops which can move at right angles to said input conveyor in order to receive said flat objects one by one therefrom and to move them into the ejection position in conjunction with said transfer member.

9. Machine according to claim 8, wherein said stops are carried by an endless belt conveyor providing a lower strand which is directed parallel to the direction of movement of said receptacles.

10. Device according to claim 1, wherein said reception conveyor is an endless belt conveyor arranged substantially in the same plane and moved in the same direction as said input conveyor, said belt carrying cams able to interact with a front edge of some of said objects in order to immobilize it during the transfer in progress of another of said objects by said transfer member.

* * * * *